US005080012A

United States Patent [19]

Fischer et al.

[11] Patent Number: 5,080,012

[45] Date of Patent: Jan. 14, 1992

[54] DRIVE FOR A MULTICOLOR SHEET-FED ROTARY PRESS

[75] Inventors: Karlheinz Fischer; Arndt Jentzsch; Victor Hefftler, all of Coswig, Fed. Rep. of Germany

[73] Assignee: VEB Kombinat Polygraph "Werner Lamberz" Leipzig, Leipzig, Fed. Rep. of Germany

[21] Appl. No.: 518,152

[22] Filed: May 3, 1990

[30] Foreign Application Priority Data

May 19, 1989 [DE] Fed. Rep. of Germany ..... 328736

[51] Int. Cl.[5] ..... B41F 5/02; B41L 17/22

[52] U.S. Cl. ..... 101/183; 101/216

[58] Field of Search ..... 101/181, 182, 183, 184, 101/185, 216, 232, 136, 137, 142, 145; 100/161, 162 R, 172, 193

[56] References Cited

U.S. PATENT DOCUMENTS 3,221,651 12/1965 Tagliasacchi ..... 101/183

3,496,865 2/1970 Fischer ..... 101/183

*Primary Examiner*—J. Reed Fisher

*Attorney, Agent, or Firm*—Michael J. Striker

[57] ABSTRACT

The drive for the multicolor rotary press has a main drive shaft, a connected synchronized gear train which extends substantially parallel to the drive shaft and which connects the press mechanisms with each other and a torsion spring-rod which couples the main drive shaft and the synchronized gear train. For coupling the main drive shaft with the synchronized gear train the torsion spring-rod is mounted on an axle journal of a press cylinder. To provide a drive for operation of the press at several different operating speeds a force-locking or frictionally-engaging coupling clutch is mounted on bevel gear shafts located between the press cylinder of one press mechanism drivable by a torsion spring-rod and another press cylinder of an adjacent press mechanism carrying a transversely moving linkage. One of the bevel gear shafts is driven by another gear coupled with the main drive shaft, so that, when the clutch is engaged, particularly at start-up and low speed operation, the press cylinders are driven without the torsion spring-rod, but when the clutch is disengaged, the press cylinders are driven through the torsion spring-rod thus damping oscillations due to gear teeth tolerances.

6 Claims, 1 Drawing Sheet

DRIVE FOR A MULTICOLOR SHEET-FED ROTARY PRESS

BACKGROUND OF THE INVENTION

Our invention relates to a drive for a multicolor sheet-fed rotary press and, more particularly, for a multicolor sheet-fed rotary press with a plurality of press mechanisms with press cylinders.

A drive for a multicolor sheet-fed rotary press is known, in which torsion spring-rods are mounted on axle journals of the press cylinder for power bypassing and reliable performance of a permanent gear unit(WP B41F 319 549.3). This method has the disadvantage that during flow of power from the main drive shaft to the press cylinder a clutch bypassing a torsion spring-rod must be provided, in order to, e.g. in the slow-speed and inching modes of operation, drive the press cylinder by the main drive shaft while the drive shaft is rigidly connected to the press cylinder. In machines with more than two press mechanisms the clutches are disadvantageously large and are not very easily accessible. Moreover additional bearing forces occur on the press cylinder and/or on the transfer drum in the inching, slow-speed, braking and starting modes of operation, when the coupling is mounted on the gear stage in front of the press cylinder. This solution is also comparatively expensive, since a clutch must be provided for each driven location in the press.

SUMMARY OF THE INVENTION

It is an object of the present invention to provide a simplified drive for a multicolor sheet-fed rotary press machine with a torsion spring-rod.

This object and others which will be made more apparent hereinafter will be attained in a drive for a multicolor sheet-fed rotary press having a plurality of press mechanisms provided with press cylinders having axle journals, which drive comprises a main drive shaft, a connected synchronized gear train which extends parallel to it and which connects the press mechanisms with each other and a torsion spring-rod which couples the main drive shaft and the synchronized gear train, the torsion spring-rod being advantageously mounted on an axle journal of a press cylinder.

In the drive according to the invention a coupling clutch is mounted on bevel gear shafts located between one press cylinder of a press mechanism drivable by a torsion spring-rod and another press cylinder of an adjacent press mechanism. The other press cylinder carries a transversely moving linkage or coupling. By action of the clutch alternatively the torsion spring-rod can be used to as a part of a coupling mechanism for a drive motor and the press cylinders or a plurality of additional gears mounted on the drive shaft and the bevel gear shafts can be used as the coupling mechanism to drive the press.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
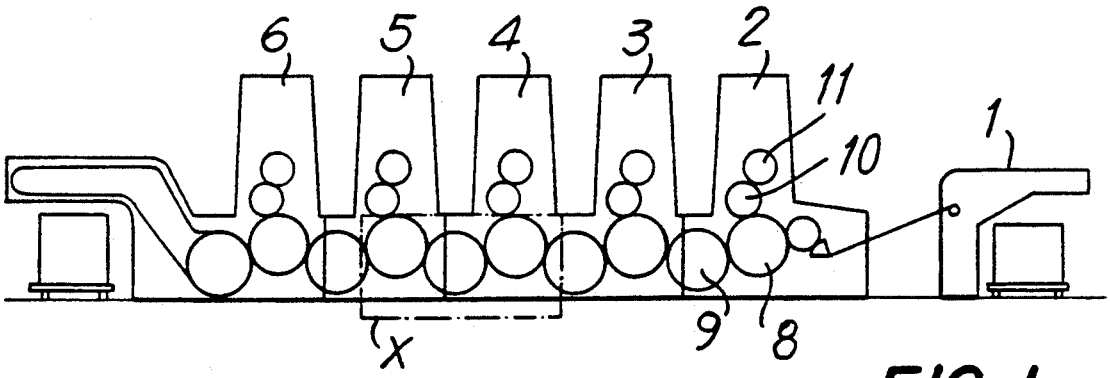
FIG. 1 is a schematic cross sectional view of a five color model of a multicolor sheet-fed rotary press.
Figure 2:
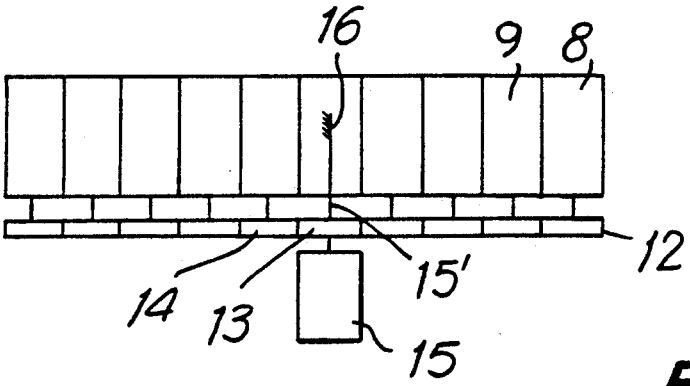
FIG. 2 is a top plan view of a drive for the multicolor sheet-fed rotary press of FIG. 1.

The five color model of the multicolor sheet-fed rotary press shown in FIG. 1 comprises a sheet feed mechanism 1, an initial press mechanism 2, other following press mechanisms 3, 4 and 5, an output press mechanism 6 and a sheet output device 7. Each of the press mechanisms 2 to 6 contains a press cylinder 8 and a transfer drum 9 as well as a rubber cylinder 10 and a plate cylinder 11. The press cylinder 8 and the transfer drum 9 of the press mechanisms 2 to 6 are connected with each other by a gear train 12, which is part of the drive of the press machine. The gear train comprises the gears 13, 14 mounted on the press cylinders 8 and the transfer drums 9. A gear drive 15, the socalled drive unit, is associated with the central press mechanism 4. This drive 15 feeds to this press mechanism press power by a torsion spring-rod 16 mounted on journal axle 15' of the press cylinder 8.

Figure 3:
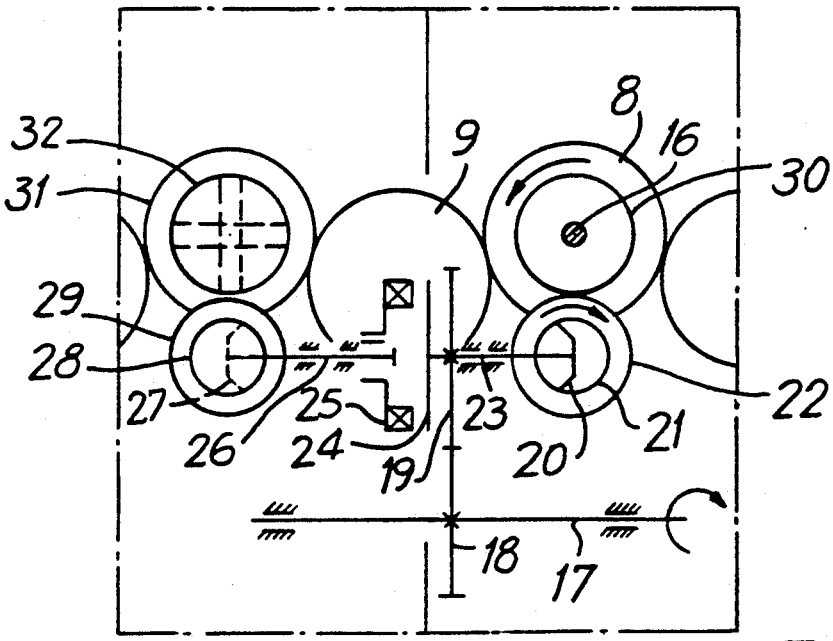
FIG. 3 is a detailed cross sectional view of a portion of the drive of FIG. 2 located in solid line box X in the press of FIG. 1.

In the embodiment according to FIG. 3 the gear drive 15 includes a through-going main drive shaft 17 driven by an unshown electric motor, a gear pair 18,19 and bevel gears 20,21 with another gear 22, which meshes with the drive gear 30, which is connected with the torsion spring-rod 16 of the press cylinder 8 of the following press mechanism 4. The bevel gear shaft 23, on which the bevel gear 20 and the gear 19 are rigidly mounted, supports a clutch half 24, which cooperates with the clutch half 25, which is mounted on the second bevel gear shaft 26. Advantageously the clutch halves 24, 25 are part of a force-locking or frictionally-coupling clutch. The bevel gear shaft carries a bevel gear 27 on an end facing away from the clutch half 25, which meshes with the bevel gear 28 and which with the drive gear 29 connected with it is engaged with the gear 31 of the press cylinder 8 of the press mechanism 5. A transverse moving coupling, e.g. a Oldham linkage 32, is mounted on the gear 31. This transverse-moving coupling transfers the drive moment concentric to the press cylinder axle. In the coupled configuration of the clutch halves 24, 25, i.e. the torsion spring-rod 16 is bypassed, the engagement of the special operating unit with the press mechanism 5 occurs for the starting, braking, slow-speed, auxiliary and manual operating modes. After release of the clutch halves 24, 25 the drive for continued printing occurs by the torsion spring-rod 16 of the press mechanism 4. This solution has the advantage that the clutch is mounted on a shaft with minimal torque and good accessibility. Thus a single clutch with two and more engagement positions suffices for start-up, slow-speed and so forth operating modes. In the mounting of the press cylinder 8 no additional bearing forces occur, since a moment engagement occurs on the press cylinder 8 of the following press mechanism 5 also in start-up, slow-speed and so forth operating modes. The bevel gear shafts must however not be located between adjacent press cylinders. It is also possible to coordinate the second bevel gear unit, 26, 27 and 28, with the clutch halves 24, 25 in the press mechanism 2 or 3. Then the power flow over the main drive shaft and an additional gear stage runs from the main drive shaft to the bevel gear shafts of a specially drive unit, which carries the clutch. The clutch 24,25 acts as a means of selecting between operating modes which drive the press mechanisms and press cylinders.

It will be understood that each of the elements described above, or two or more together, may also find a useful application in other types of constructions differing from the types described above.

While the invention has been illustrated and described as embodied in a drive for a multicolor sheet-fed rotary press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A drive for a multicolor rotary press, said rotary press comprising a plurality of press mechanisms, each of said press mechanisms having a press cylinder, said drive comprising:

motor means for driving said press mechanisms and press cylinders, a main drive shaft connected with said motor means so as to be rotatably driven by said motor means, a connected synchronized gear train extending substantially parallel to said drive shaft and including a plurality of intermeshing gears, each of said press cylinders being nonrotatably coaxially connected in one of said press mechanisms with one of said intermeshing gears of said synchronized gear train so that, when one of said press cylinders rotates, all of said press cylinders rotate by said synchronized gear train, a torsion spring-rod connected rigidly to and extending coaxially from one of said press cylinders of one of said press mechanisms, said torsion spring-rod also being connectable by a plurality of other gears to said main drive shaft, so that, when said torsion spring-rod is connected with said drive shaft by said other gears and said main drive shaft is driven by said motor means, said one of said press cylinders is rotatably driven by said torsion spring-rod, a plurality of additional gears connected to said main drive shaft and also connectable to another of said press cylinders, when said one of said press cylinders is not in operative connection with said main drive shaft, so as to drive said press cylinders without said torsion spring-rod, and means for selecting and engaging one of said plurality of additional gears driving said press cylinders without said torsion spring-rod and one of said plurality of other gears driving said press cylinders by said torsion spring-rod.

2. A drive according to claim 1, wherein said press cylinders have axle journals and said torsion spring-rod is mounted on one of said axle journals.

3. A drive for a multicolor rotary press according to claim 1, wherein said means for selecting and engaging comprises a clutch having two rotatable clutch halves, said clutch halves being engagable so as to be rotatable together and disengagable so as to be separately rotatable, two rotatable bevel gear shafts, each of said clutch halves being axially nonrotatably mounted on one of said bevel gear shafts, one of said additional gears being nonrotatably mounted on one of said bevel gear shafts and one of said other gears being nonrotatably mounted on the other of said bevel bear shafts, said clutch and said gears being so structured that, when said clutch is engaged, said main drive shaft drives said additional gears and said press cylinders without said torsion spring-rod and, when said clutch is disengaged, said main drive shaft drives said other gears and said press cylinders are driven by said torsion spring-rod.

4. A drive for a multicolor rotary press according to claim 3, wherein one of said additional gears is coupled to the other press cylinder drivable by said additional gears via a transverse moving coupling.

5. A drive for a multicolor rotary press according to claim 4, wherein said transverse moving coupling is an Oldham linkage.

6. A drive for a multicolor rotary press according to claim 1, wherein said clutch is frictionally-engaging.

* * * * *